United States Patent [19]

Eckstein et al.

[11] 4,154,236

[45] May 15, 1979

[54] OXYGEN RESPIRATOR WITH OXYGEN-SUPPLYING CHEMICAL CARTRIDGE

[75] Inventors: Wolfgang Eckstein, Sereetz; Gerd Pantaleon-Stemberg, Mölln; Adalbert Pasternack, Bad Schwartau; Bodo Heins, Arfrade, all of Fed. Rep. of Germany

[73] Assignee: Drägerwerk Aktiengesellschaft, Fed. Rep. of Germany

[21] Appl. No.: 814,882

[22] Filed: Jul. 11, 1977

[30] Foreign Application Priority Data

Jul. 24, 1976 [DE] Fed. Rep. of Germany ..... 2633344

[51] Int. Cl.[2] ..... A62B 7/10

[52] U.S. Cl. ..... 128/191 R; 128/142 R; 128/147

[58] Field of Search ..... 128/191 R, 142 R, 142.2, 128/142.4, 142.6, 146.6, 142.3, 203, 147; 23/281; 55/DIG. 33, DIG. 35

[56] References Cited

U.S. PATENT DOCUMENTS

| | | | |
|---|---|---|---|
| 2,507,450 | 5/1950 | Millikan et al. | 128/203 |
| 3,276,846 | 10/1966 | Moni et al. | 23/281 |
| 3,397,693 | 8/1968 | Warncke | 128/191 R |

FOREIGN PATENT DOCUMENTS

| | | | |
|---|---|---|---|
| 4177 of | 1911 | United Kingdom | 128/191 R |
| 306854 | 6/1972 | U.S.S.R. | 128/191 R |

*Primary Examiner*—Henry J. Recla
*Attorney, Agent, or Firm*—McGlew and Tuttle

[57] ABSTRACT

An oxygen respirator, comprises a portable container having a cartridge chamber with a cylindrical oxygen-supplying chemical cartridge centrally located in the chamber and with a replaceable $CO_2$-absorbing cartridge concentrically surrounding the chemical cartridge. The cartridge chamber is closed by a baseplate which includes a mouthpiece connection defining a mouthpiece passage for respirator air for the user which connects downwardly into the chamber through an associated check valve for flow downwardly through the annular $CO_2$-absorbing cartridge and upwardly through the oxygen-supplying chemical cartridge which, after initial ignition, supplies oxygen to the respiratory air which is circulated back to the mouthpiece passage either directly or through a breathing bag which is mounted in the respiratory air breathing passages.

11 Claims, 3 Drawing Figures

OXYGEN RESPIRATOR WITH OXYGEN-SUPPLYING CHEMICAL CARTRIDGE

FIELD AND BACKGROUND OF THE INVENTION

This invention relates in general to respirators and, in particular, to a new and useful oxygen respirator with an oxygen-supplying chemical cartridge disposed in a portable container and having means for the circulation of the respiratory air.

DESCRIPTION OF THE PRIOR ART

Respirators which are carried on the body must be small, lightweight and must not be in the way either when in a standby position or during operation. Further, they cannot be susceptible to shock or other mechanical stresses. All oxygen-supplying cartridges have in common that the chemical reactions are of an exothermic nature. Cooling of the regenerated gas to be inhaled is therefore of the utmost importance. A temperature of the gas to be inhaled which is too high hinders the user of the respirator, and can make breathing impossible after a short time.

A known oxygen respirator, where the respiratory air is circulated, in addition to the oxygen-supplying chemical cartridge, contains a face mask which is provided with an inhalation and an exhalation tube, a breathing bag, and an attachment with a composition which gives off both oxygen and heat after ignition. The oxygen-supplying chemical cartridge is arranged between the exhalation tube and the breathing bag. In use, the time required for the start of the reaction, and the supply of sufficiently large amounts of oxygen depends on the ambient temperature. The attachment supplies oxygen immediately after ignition to the circulating respiratory air, and simultaneously heats the respiratory air and regions adjacent to the oxygen-supplying chemical in order to activate the chemical cartridge. The chemical cartridge contains a chemical which reacts with the carbon dioxide contained in the exhaling air and with water, and then gives off oxygen. The generated reaction heat is eliminated by the inhaling air moving over the cartridge case. The case becomes very hot during the reaction. The apparatus has no means for preventing excessive heating of the respiratory air or to reduce the outside temperature of the chemical cartridge or to protect the cartridge against direct contact. Use of this apparatus in rooms containing explosive mixtures in not possible. (See DAS 1,085,040).

Another known respirator differs from the above-mentioned type in respect to the provision of an oxygen cylinder instead of the attachment with the oxygen-and heat-supplying composition. At the beginning, the oxygen cylinder is opened to supply the user with oxygen until the chemical cartridge is activated. The chemical cartridge is surrounded by a housing which is provided with holes, which serve to improve the elimination of heat. The protection against contact may therefore be better. However, it is not sufficient to permit its use in rooms containing an explosive mixture (German Pat. No. 1,150,873).

Another oxygen respirator with pendulum breathing through a breathing tube consists of a cartridge connected to the tube and filled with an oxygen-developing chemical, and a breathing bag is secured on the side of the cartridge opposite to the breathing tube connection. Curved plates which are provided on the outside with a heat-insulating fabric are arranged at a distance around the narrow sides of the cartridge case. A chimney effect is produced in the interval around the cartridge case. The resulting air movement serves to eliminate the heat. A sufficient heat-insulating effect is not obtained (See German Pat. No. 1,132,802).

All known oxygen respirators have in common also that the inhaling or exhaling air is conducted through the oxygen-supplying cartridge and is thus considerably heated, but in none of these is the chemical cartridge enclosed. The wall thus becomes very hot and the apparatus are usually unsuitable for use in rooms containing explosive gas mixtures. Furthermore, they require steam-tight packing. The penetrating moisture would start a reaction which could lead to premature consumption of the chemical cartridge.

SUMMARY OF THE INVENTION

The present invention provides a small, lightweight oxygen respirator which is resistant to mechanical stresses. Parts which are consumed are constructed so as to be simple and safe to replace. The inventive device does not have the prior art disadvantages and, particularly, the temperature of the inhaling air is physiologically harmless, and the outside temperature of the apparatus remains so low that it can also be used in rooms containing explosive mixtures and ambient moisture is not harmful to the apparatus of the invention.

The invention includes a replaceable chemical cartridge with a concentrically surrounding, replaceable $CO_2$-absorbing cartridge underneath a baseplate carrying the permanent parts breathing tube and mouthpiece, the breathing bag and the valves and the starter. The baseplate is secured tightly with the upper part of the $CO_2$-absorbing cartridge.

The particular advantages achieved with the present invention consist in that the parts are arranged compactly in the portable container. Due to the triple division of the container into a baseplate and two replaceable cartridges, the exchange of the two cartridges as used up parts is very simple. The $CO_2$-absorbing cartridge surrounding the chemical cartridge concentrically permits an extremely favorable utilization of space. Beyond that, it provides maximum insulation against loss of heat. The filling of the $CO_2$-absorbing cartridge acts as an insulator. The exhaling air conducted through the $CO_2$-absorbing cartridge is very moist when it enters. The evaporation of the water portion in the filling material results in cooling due to the heat of evaporation. In any case, it prevents that the contact temperature, which must not exceed 85° C. for use in rooms containing explosive mixtures, is attained, and use in these rooms is thus possible. Due to the cooling in the $CO_2$-absorbing cartridge, the temperature of the inhaling air becomes acceptable for the user.

In a further development of the invention, the baseplate has a joining socket for the breathing tube and a socket for the breathing bag which are connected by a duct, whose opening is provided with a relief valve opening into the joining socket. The socket is open through a respiratory air pipe to the space. The easy replacement of the used-up cartridge is further increased by the design of the baseplate. Beyond that, safe cleaning is possible. In a further development, either the space above the chemical cartridge is connected with the antechamber for the $CO_2$-absorbing cartridge by a relief valve opening into the latter, or the space above the chemical cartridge is connected with the socket for the breathing bag by a relief valve opening into the socket. Both suggestions for feeding the oxygen released in the chemical cartridge into the respiratory air current ensure that the portion used up during breathing is replaced in the circulating respiratory air. The total balance remains the same. In the former case, the respiratory air is somewhat moister.

In order to balance the oxygen formed in a constant amount with the varying air consumption during respiration, the breathing bag has an excess pressure valve. The excess respiratory air can thus flow off into the surrounding atmosphere.

Due to the design of the chemical cartridge as an oxygen-supplying candle in a can, the respiratory air does not have to be conducted through the cartridge because moisture and carbon dioxide are not necessary for the reaction. The candle burns automatically after it is lighted. The chemical cartridge is insensitive to moisture. This considerably facilitates the checking and care of the respirator in the standby position.

Accordingly, an object of the invention is to provide an oxygen respirator which comprises a portable container having a cartridge chamber with a baseplate which closes the chamber and which carries means defining a mouthpiece passage for the respirator user and a respirator air flow path which connects to a replaceable cylindrical oxygen-supplying cartridge in the chamber which is surrounded by a $CO_2$-absorbing cartridge so that respiratory air will circulate through the $CO_2$ cartridge and the oxygen-supplying cartridge and be conducted through valves and associated passages on the baseplate for circulating the oxygen-enriched gases back through the mouthpiece passage or into a breathing bag for subsequent direction back to the mouthpiece.

A further object of the invention is to provide an oxygen respirator with oxygen-supplying chemical cartridge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
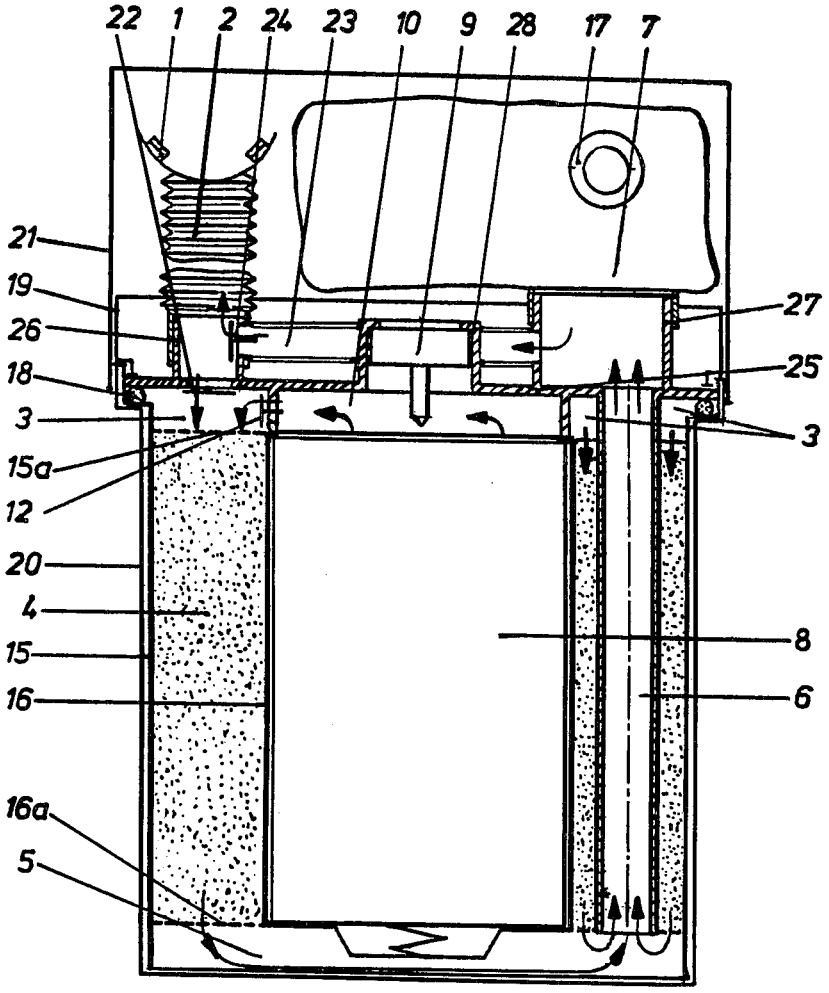
FIG. 1 is a vertical sectional view of an oxygen respirator constructed in accordance with the invention.
Figure 2:
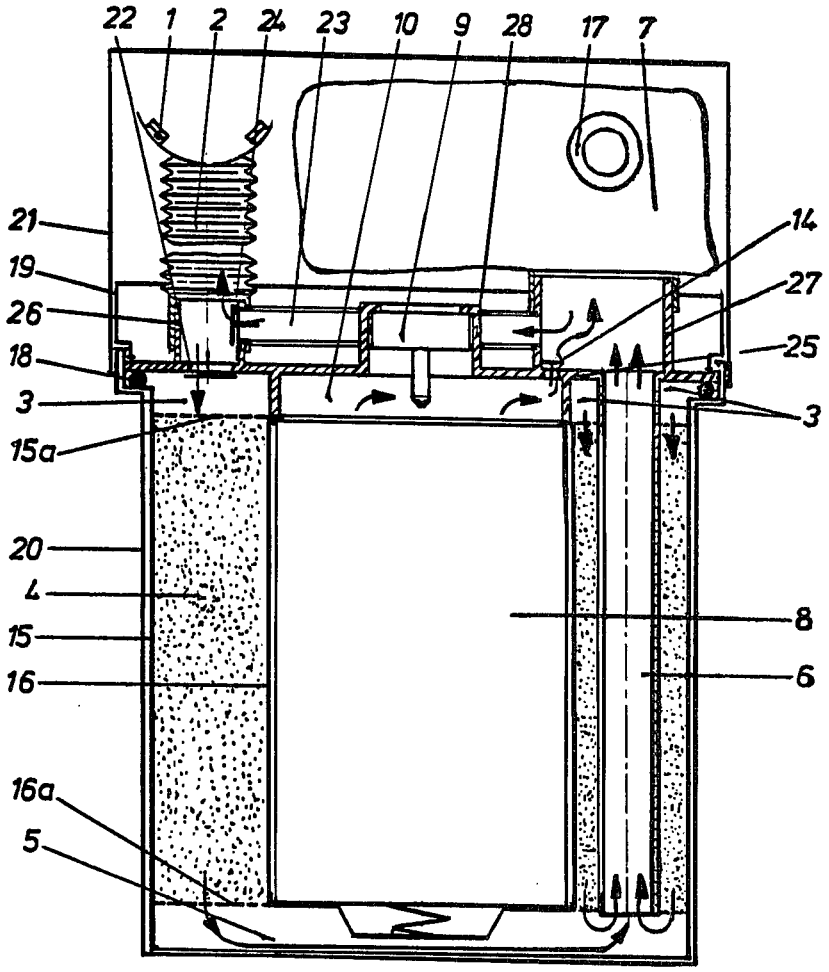
FIG. 2 is a view similar to FIG. 1 of another embodiment of the invention.
Figure 3:
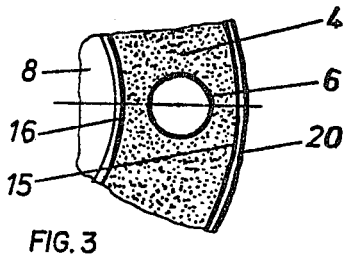
FIG. 3 is a partial horizontal sectional view of the respirator container chamber of both embodiments.

Referring to the drawings in particular to FIGS. 1 and 2, parts of an oxygen respirator are disclosed therein which are substantially identical except for the respirator air flow passages which lead from a mouthpiece 1 through a chamber 5 which contains $CO_2$-absorbing means 4 and oxygen-supplying means 8 for treating the respirator air prior to its return to the mouthpiece passage 2 of the mouthpiece 1.

In the embodiment of FIG. 1, the oxygen respirator is arranged in a standby position in a portable container consisting of a bottom part 20 with a cover 21. For use, cover 21 is opened, mouthpiece 1 is taken into the mouth in a known manner, and the nose is closed by a nose clamp, known per se. The exhaling air flows through mouthpiece 1 and breathing tube 2 through relief valve 22 opening with the exhaling pressure into antechamber 3, which permits a uniform entrance of the air into an annular $CO_2$-absorbing cartridge 4.

The $CO_2$-absorbing cartridge 4 contains the absorption material breathing lime, in a pot with outer wall 15 and inner wall 16. The axial terminations for the absorption material form sieves or perforated plates 15 and 16*a*. The $CO_2$-absorbing cartridge 4 is filled with breathing lime in a known manner. A respiratory air return pipe 6 extends into the filling chamber 5 and it is parallel to the chamber axis. The $CO_2$-absorbing cartridge 4 is arranged concentrically about an oxygen-supplying chemical cartridge 8. The cartridge 8 is a known oxygen-supplying candle in a can. It is lighted by a starter 9 and then burns by itself.

After passing through the $CO_2$-absorbing cartridge 4 in which the carbon dioxide is retained, the exhaling air flows into the lower part of chamber 5 and from there, it flows through respirator air pipe 6. Pipe 6 is carried by a baseplate 25, and it is placed into the $CO_2$-absorbing cartridge 4 and connects through the socket 27 into the breathing bag 7.

The oxygen used up in breathing is replaced from the oxygen-supplying chemical cartridge 8. The oxygen released during the burning of the cartridge 8 is fed to the exhaling air either according to FIG. 1 from space 10 through relief valve 12 and cartridge 4 or, according to FIG. 2, through relief valve 14 through socket 27 directly to breathing bag 7. Breathing bag 7 has an excess pressure valve 17 so that excess respirator air can be discharged to the outside.

In the inhalation phase, the respiratory air, which has again become breathable, is sucked in by the user from the breathing bag 7 through connecting duct 23, relief valve 24 opening in the direction of flow, and breathing tube 2 with mouthpiece 1.

Chemical cartridge 8 and $CO_2$-absorbing cartridge 4 can be replaced after they have been used up. To this end, baseplate 25 can be removed from the upper part of the $CO_2$-absorbing cartridge 4. It carries breathing tube 2 with mouthpiece 1 on joining socket 26. The two relief valves 22 and 24 are arranged in the socket 26. Socket 27 with breathing bag 7, connecting duct 23 and respiratory air pipe 6 are also rigidly connected with baseplate 25. In addition, for the supply of oxygen, either relief valve 12 or 14 are provided on the baseplate. A starter 9 is arranged in dome 28 of baseplate 25. Baseplate 25 is disposed between intermediate housing 19 and bottom part 20 and seals the space receiving chemical cartridge 8 and $CO_2$-absorbing cartridge 4 from the outside.

While specific embodiments of the invention have been shown and described in detail to illustrate the application of the principles of the invention, it will be understood that the invention may be embodied otherwise without departing from such principles.

What is claimed is:

1. An oxygen respirator, comprising a portable container having a central cartridge chamber, a baseplate closing said chamber, a replaceable cylindrical oxygen supplying chemical cartridge in said cartridge chamber, a replaceable $CO_2$ absorbing cartridge concentrically surrounding said chemical cartridge chamber providing an insulation and cooling for said central cartridge chamber, means associated with said baseplate defining mouthpiece passage means for the respirator air and respiratory air flow passage means through said $CO_2$ absorbing cartridge and communicating with said chemical cartridge chamber and returning respiratory air to said mouthpiece passage means, means providing one way flow through said respiratory air flow passage means, said oxygen supplying chemical cartridge liberating oxygen into said flow passage means and providing heat, said carbon dioxide absorbing cartridge, during the passage of air therethrough, cooling the space surrounding said cartridge chamber, and starter means to start said chemical cartridge to liberate oxygen into the respiratory air, said means associated with said baseplate includes a joining socket on said baseplate, a connecting passage extending from said joining socket to said mouthpiece passage means and a respiratory air return pipe connected to said socket and extending into said $CO_2$-absorbing cartridge and forming a part of said airflow passage means, said air flow passage means also including a housing defining a return flow space below said $CO_2$ absorbing cartridge communicating with said air flow path through said $CO_2$ absorbing cartridge, a breathing bag connected to said socket, said connecting passage from said socket to said mouthpiece passage means having relief valve means communicating with said chemical cartridge chamber whereby oxygen generated by said chemical cartridge is communicated to said air flow passage means via said relief valve.

2. An oxygen respirator, according to claim 1, wherein said respirator air return pipe communicates at its lower end with said return flow space below said $CO_2$-absorbing cartridge.

3. An oxygen respirator, according to claim 1, wherein space is defined between said baseplate and said oxygen-supplying cartridge and said $CO_2$-absorbing cartridge forming an annular antechamber space and an oxygen generating space, said antechamber space being connected to said mouthpiece passage, said mouthpiece passage means having a one-way valve opening into said antechamber.

4. An oxygen respirator, according to claim 1, wherein there is a space between said baseplate and said chemical cartridge, a socket disposed above said baseplate, said relief valve means communicating said space above said chemical cartridge with said socket.

5. An oxygen respirator, according to claim 1, wherein said breathing bag connected to said socket includes an excess pressure valve permitting venting of said breathing bag.

6. An oxygen respirator, according to claim 1, wherein said oxygen-supplying cartridge comprises a oxygen-supplying candle in a can.

7. An oxygen respirator, comprising a cylindrical container having a side wall a closed bottom wall and an open top, a baseplate closing said top, wall means defining a cylindrical inner chamber within said container and spaced interiorly of the side walls of said container, chemical oxygen liberating means in said cylindrical container tending to produce heat upon the liberation of oxygen, an annular cartridge surrounding said wall means in the space between said wall means and the interior of said container, a return flow space defined in said container between said bottom wall and said annular cartridge and said wall means defining said cylindrical chamber, said annular cartridge having a carbon dioxide absorbing medium therein, respiratory air flow passage means including a mouthpiece connection connected to said base plate and communicating with said annular cartridge for the flow of respiratory air through the $CO_2$ absorbing medium in said cartridge to said return flow space, a respiratory air return passage extending from said return flow space through said annular cartridge and to said mouthpiece connection, means providing one-way flow through said flow passage means, said oxygen liberating means communicating with the respiratory air circulated through said flow passage means, said return flow space and said return passage for adding oxygen to the respiratory, the air passing through said carbon dioxide absorbing medium tending to become cooled by the absorption of the carbon dioxide so as to cool the space surrounding the oxygen liberating medium said base plate being spaced above said annular cartridge defining an antechamber above said $CO_2$ absorbing medium and below said baseplate, said baseplate also being spaced above said oxygen liberating means defining an oxygen generation space, and relief valve means communicating said oxygen generation space with said respiratory air flow passage means whereby oxygen from said oxygen gas liberating means is supplied to the respiratory air circulated therethrough.

8. An oxygen respirator according to claim 7, wherein said relief valve means communicates said oxygen generation space with said antechamber.

9. An oxygen respirator according to claim 7, wherein said respiratory air return passage includes a pipe extending through said $CO_2$ absorbing medium and terminates in a socket connected to said baseplate, a breathing bag connected to said socket and a connection line extending from said socket to said mouthpiece connection.

10. An oxygen respirator according to claim 7 wherein said mouthpiece connection includes a mouthpiece hose and wherein said one-way flow means includes valve means associated with said connection line and said return passage.

11. An oxygen respirator according to claim 7 wherein said relief valve means communicates said oxygen generations space with said socket.

* * * * *